US006349512B1

(12) United States Patent
Berkey et al.

(10) Patent No.: US 6,349,512 B1
(45) Date of Patent: Feb. 26, 2002

(54) ADJUSTABLE SUPPORT POST

(75) Inventors: John William Berkey, Littleton; Kenneth G. Joern, Greenwood Village, both of CO (US)

(73) Assignee: Steel Floors, LLC, Henderson, CO (US)

( * ) Notice: Subject to any disclaimer, the term of this patent is extended or adjusted under 35 U.S.C. 154(b) by 0 days.

(21) Appl. No.: 09/292,245

(22) Filed: Apr. 15, 1999

Related U.S. Application Data

(60) Provisional application No. 60/092,184, filed on Jul. 9, 1998.

(51) Int. Cl.[7] ..... E04B 9/00; E04G 21/04
(52) U.S. Cl. ..... 52/126.6; 52/127.2
(58) Field of Search ..... 52/736.1, 127.2, 52/126.6, 263, 726.3; 248/125.8, 354.1, 354.3

(56) References Cited

U.S. PATENT DOCUMENTS 2,504,291 A * 4/1950 Alderfer ..... 248/354.3 X
3,027,140 A * 3/1962 Holzbach ..... 248/354.3 X
3,222,030 A * 12/1965 Thorpe ..... 248/354.3 X
4,546,581 A * 10/1985 Gustafson ..... 52/126.6 X
4,570,397 A * 2/1986 Creske ..... 52/126.6
5,727,767 A * 3/1998 Jefrey ..... 248/354.3 X
5,826,847 A * 10/1998 Warner et al. ..... 248/354.1

FOREIGN PATENT DOCUMENTS

JP 7-154581 1/1997

* cited by examiner

*Primary Examiner*—Daniel P. Stodola
*Assistant Examiner*—Hugh B. Thompson
(74) *Attorney, Agent, or Firm*—Rick Martin; Patent Law Offices of Rick Martin P.C.

(57) ABSTRACT

A support post for use in construction mounted to the floor with a base collar which is provided with spacer rings for height adjustment. The spacer rings are inserted into the base collar before the support post is in order to provide additional height for the support post as needed in the field.

19 Claims, 2 Drawing Sheets

ADJUSTABLE SUPPORT POST

CROSS REFERENCE PATENTS

This application is a non-provisional application claiming the benefits of provisional application No. 60/092,184 filed on Jul. 9, 1998.

FIELD OF INVENTION

The present invention relates to support posts for floor joists.

BACKGROUND OF THE INVENTION

In a house with a basement, there are often support posts to carry the weight of the floor joists of the first floor. The floor joists are supported by steel I beams. The basement floor is generally either a poured concrete slab or a structural floor. The concrete floor settles as it is drying. The ground underneath also settles. Structural floors are often designed to have different head heights.

As a consequence of the uneven basement floor, the support posts connected to the I beams supporting the first floor are not all the same height. Additionally the support post heights also differ from job to job. The prior art post, shown in FIG. 1 is a 3½ inch outside diameter steel post 101. The bottom end 108 of the post 101 is welded to a base plate 110. The base plate 110 has two steel straps 111, 112 welded to the top surface 113 of the base plate on either side of the bottom end 108. The base plate 110 is attached to the I beam 114 in the basement floor by bending the straps 111, 112 over the top flange 115 of the I beam 114.

It is important that the bottom end 101 of post 101 be cut square so that all of the load is evenly transferred to I beam 114. This is normally assured by cutting the post in a shop, not on site.

The post 101 has a top end 102, with a hole (not shown) centered in the top end 102. A threaded nut 103 is set on the center of the top end 102 over the hole. A bolt 104 is threaded into nut 103 and fed through the hole. The weight of the floor and the bolt 104 extending through the hole hold the nut 103 in place.

The bolt 104 is attached to the bottom 105 of mounting plate 107. The top side 106 of mounting plate 107 is attached to the floor joist with steel straps (not shown) identical to the base plate. The bolt 104 can be threaded into the nut to increase or decrease the overall height of the post. This prior art system allows for 3 inches of total adjustment in the height of the post.

The major disadvantage to the prior art system is that it only allows for 3 inches of adjustment in the height of the post. If more than that is needed, then longer or shorter posts must be obtained. This can result in significant inconvenience and delay, particularly on remote job sites. Generally a new post must be obtained, again often with significant delay. These delays can cost a contractor significant amounts of money as there are almost always penalties for not getting a job completed on schedule.

Another common problem is that the entire set of posts ordered for a given job are either too long or too short. This is due to communication problems. Either the wrong height of the basement gets conveyed in the first place, or a change is made once construction has started, and this does not get conveyed to the contractor in time. In the prior art system this could mean significant delay as a whole new set of posts would need to be ordered.

The present invention solves these problems by allowing for significantly more adjustability of the height of the posts.

This is accomplished by using steel spacer rings slid into the base collar to adjust the height of the post.

SUMMARY OF THE INVENTION

The primary aspect of the present invention is to provide an easy method to allow the height of support posts to be adjusted.

A second aspect of the present invention is to allow faster installation of the support posts.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
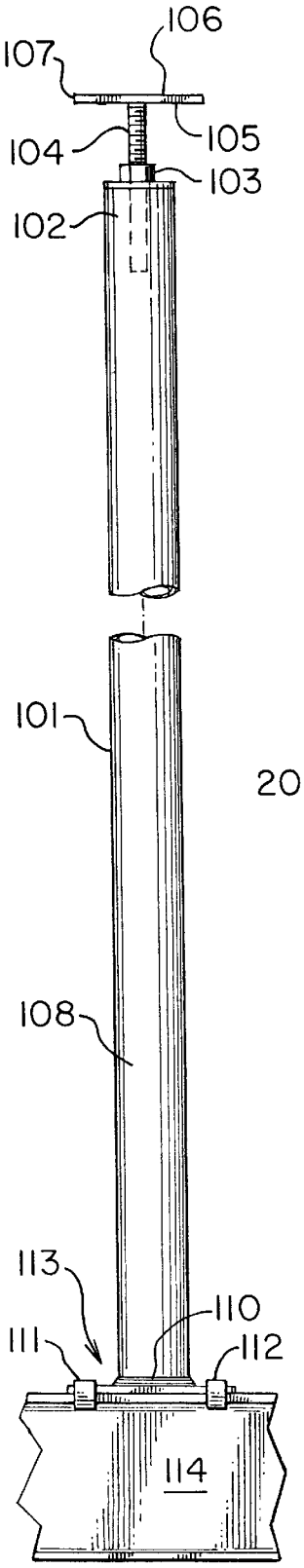
FIG. 1 (PRIOR ART)
FIG. 1 (prior art) is a side plan view of the prior art post.
Figure 2:
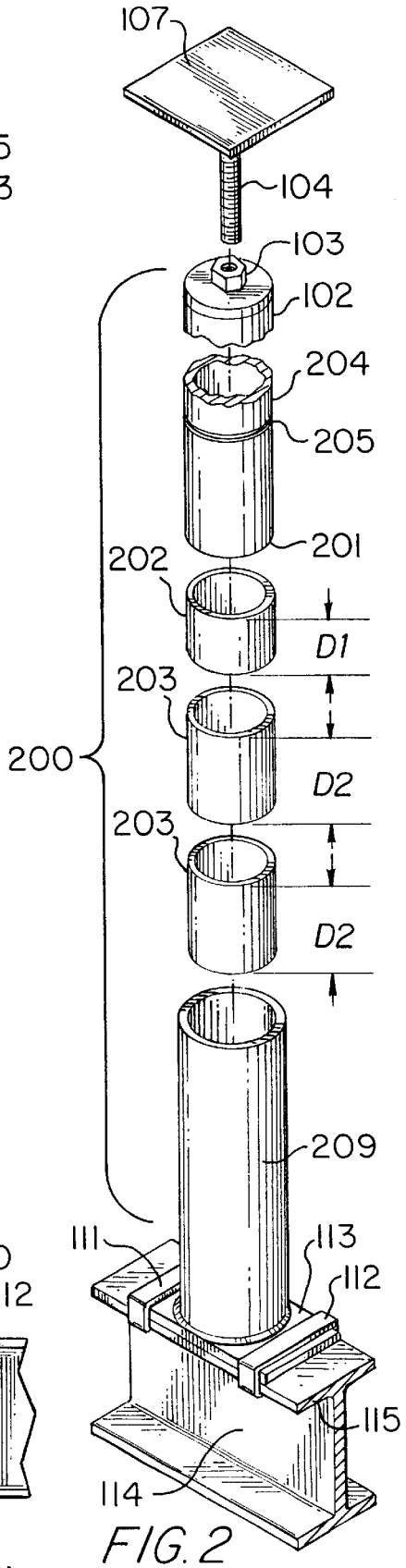
FIG. 2 is an exploded view of the preferred embodiment of the present invention.
Figure 3:
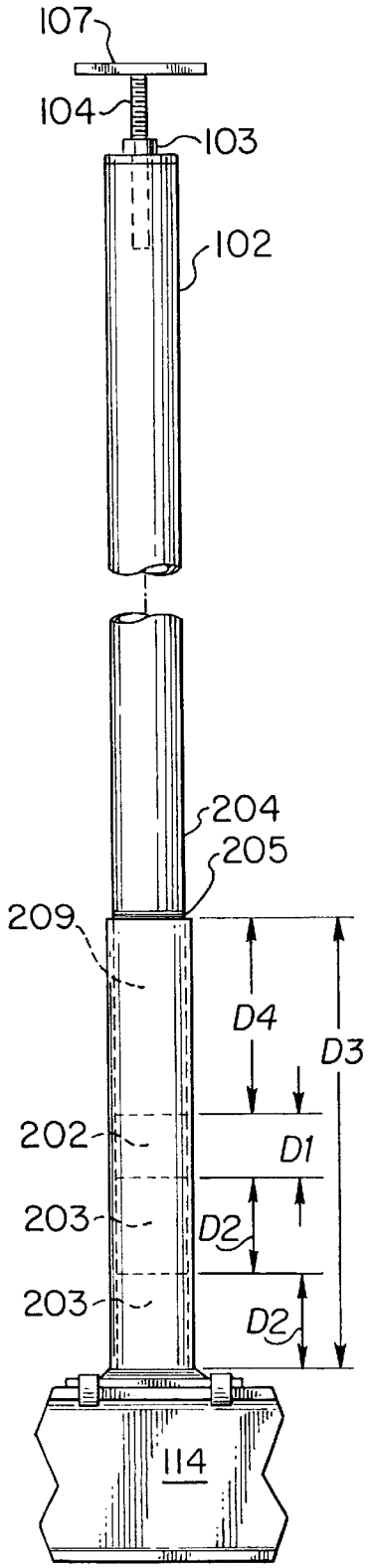
FIG. 3 is a side plan view of the preferred embodiment of the present invention.

Referring first to FIGS. 2 and 3, the support post 204 is preferably made from schedule 40 pipe with a 3½ inch outer diameter. The post can be 7 feet, 4 inches to 8 feet, 3 inches, depending on the height range desired. The top end 102 of the present invention is identical to the prior art. The top end 102 with the threaded bolt 104 allows for small, exact adjustments. In order to provide for larger adjustments, base collar 209 and spacer rings 202, 203 and 205 are provided.

The base collar 209 is a 4 inch outside diameter metal pipe with an inside diameter of 3½ inches and a preferred height of 14 inches. The base collar 209 is welded to a base plate 113. The base plate 113 has two steel straps 111, 112 welded to the top surface 113 of the base plate on either side of the base collar 209. The base plate 113 is attached to the I beam 114 in the basement floor by bending the straps 111, 112 over the top flange 115 of the I beam 114.

The spacer rings have a length of $D_1$ or $D_2$, as shown in FIGS. 2 and 3. The spacer rings 202, 203 have identical diameter to the support post 204. In the preferred embodiment $D_1$ is 2 inches and $D_2$ is 3 inches. It can be seen that $D_4$ is 6 inches which is the insertion depth of the support post 204 into the base collar 209. It is important that the bottom end 201 of post 204 and the spacer rings 202, 203 be cut square so that all of the load is evenly transferred to I beam 114 and no stress is put on the base collar 209 or on the spacer rings 202, 203. This is normally assured by cutting the post 204 and the spacer rings 202, 203 in a shop, not on site.

The overall height of the support post 200 is adjusted by placing one or more spacer rings inside the base collar 209. The bottom end 201 of the post 204 is then inserted into the base collar 209.

It is required that the support post 204 has a minimum insertion $D_4$ into the base collar 209 of 6 inches to ensure proper stability. In order to ensure that the support post 204 has been inserted the required minimum, a line 205 could be marked on the support post 6 inches from the bottom edge 201. This allows for easy visual inspection of the installed post by an inspector. The marking can be paint or similar material or it could be scored on the post.

The height of the base collar 209 is $D_3$. In the preferred embodiment $D_3$ is 14 inches. This allows for a total adjustment range of 8 inches, plus the 3 inches from the prior art top adjustment. The spacer rings 202, 203 can be used alone or in combination to provide 2, 3, 4, 5, 6, 7 or 8 inch adjustments within the base collar 209. Adjustments of less than 3 inches are done using the threaded bolt 104. This allows for a total amount of adjustment of 11 inches.

Figure 4:
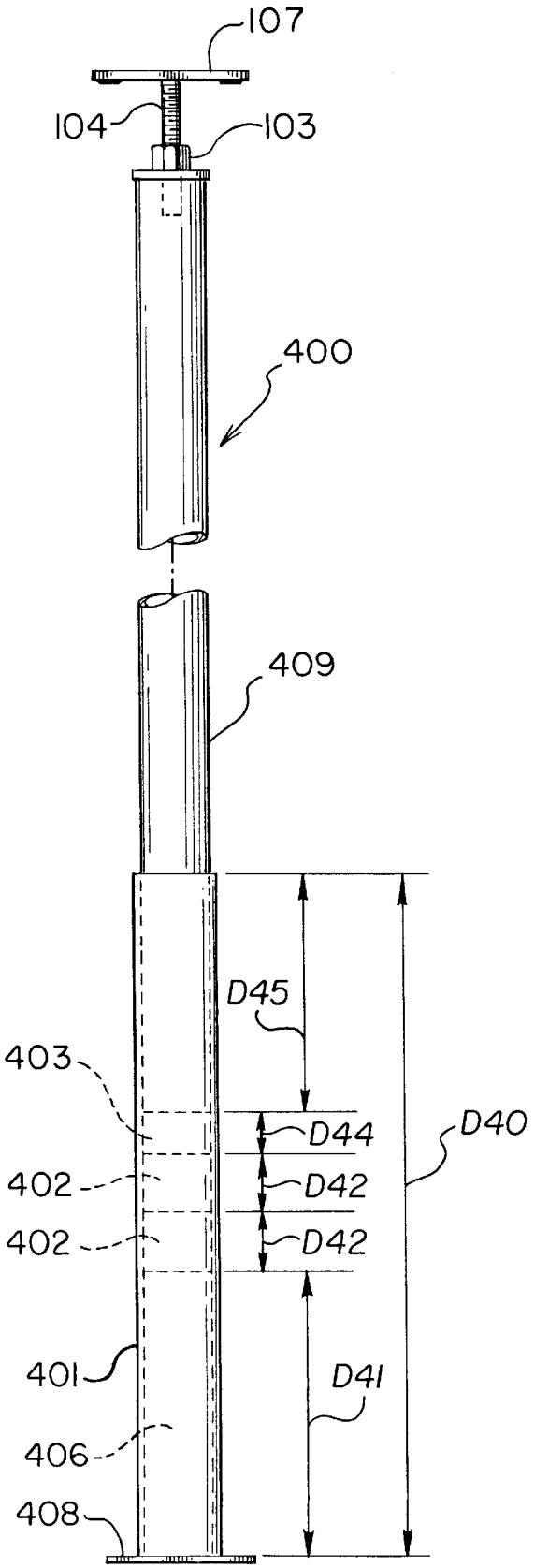
FIG. 4 is a side plan view of a support post having a high base collar.

Referring next to FIG. 4 a support post 400 is preferably made of schedule 40 pipe with a 3½ inch outer diameter. The shaft 409 can be over 7 feet in height. The support post 400 comprises the shaft 409 inserted into the base collar 401 which has a base plate 408. Spacers 402,403 and 406 are inserted into the base collar 401 to provide a desired height for the support post 400. Nominal dimensions are $D_{40}$= 2'10"; $D_{41}$=14"; $D_{42}$=3"; $D_{44}$=2"; $D_{45}$=12". $D_{45}$ is the minimal insertion length of the shaft 409 into the base collar 401.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. An adjustable support post assembly comprising:

a base collar having a height ($D_3$), an open top end and a base;

a planar base plate attached to the base of said base collar;

said planar base plate having a flat upper surface and forming a hollow space with the base collar;

the hollow space defined by a volume no less than the volume of the collar;

a support post having a bottom end adapted to slidingly engage the open top end of said base collar and rest on said base plate; and at least one dimensioning spacer ring means having a height less than the base collar height ($D_3$) and functioning to fit inside said base collar, partially filling said hollow space, to support said support post against said base plate and add a desired height to the support post.

2. The adjustable support post assembly of claim 1, wherein said at least one dimensioning spacer ring is hollow.

3. The adjustable support post assembly of claim 2, wherein three spacer rings are stacked vertically inside the base collar to add a desired height to the support post.

4. The adjustable support post assembly of claim 1, wherein three dimensioning spacer rings are stacked vertically inside the base collar to add a desired height to the support post.

5. The adjustable support post assembly of claim 4, wherein the base collar height ($D_3$) is 14 inches.

6. The adjustable support post assembly of claim 5, wherein a combined height of one or more spacer rings is equal to or less than about eight inches.

7. The adjustable support post assembly of claim 1, wherein the base plate further comprises:

at least one steel strap mounted to said base plate, said steel strap being bent to mount said base plate to a surface.

8. The adjustable support post assembly of claim 1, wherein the support post further comprises a marking line means at a set distance above the bottom end of said support post functioning to be used to ensure a proper insertion into the base collar wherein the marking line means forms an alignment with the open top end of the base collar to prevent a user from setting the marking line means above the open top end of the base collar.

9. The adjustable support post assembly of claim 8, wherein the marking line means is about 6 inches from the bottom end of said support post.

10. The adjustable support post assembly of claim 1, wherein the spacer ring has a height of about two inches.

11. The adjustable support post assembly of claim 1, wherein the support post, base collar and spacer ring means are made from metal.

12. The adjustable support post assembly of claim 1 further comprising:

a top end of said support post, said top end having a hole, a nut set above said hole, and a mounting plate, having a bolt extending from one side, said bolt being threadably engaged with said nut, functioning to adjust the overall height of said support post a given distance.

13. The adjustable support post assembly of claim 12, wherein the mounting plate further comprises:

at least one steel strap mounted to said mounting plate, said steel strap being bent to mount said mounting plate to a surface.

14. A structural support post assembly comprising:

a central post having a top;

a receiving collar to removably engage the central post on top of a base plate;

a void space defined by the receiving collar and the base plate;

the void space defined by a volume no less than about the volume of the receiving collar; and a removable spacer means in between the base plate and the central post slidably engaged in the void space and functioning to be a weight bearing structure between the central post and the base plate and to be a height adjustment for the central post.

15. The structural support post assembly of claim 14, wherein the receiving collar has a height of about 2'10".

16. The structural support post assembly of claim 15, wherein the removable spacer further comprises a first spacer having a height of about two inches, a second and a third spacer each having a height of about 3 inches, and a forth spacer having a height of about 14 inches.

17. The structural support post assembly of claim 14, wherein the removable spacer means has a height ($D_1$) which is smaller than a height ($D_3$) of the receiving collar.

18. The structural support post assembly of claim 17, wherein the removable spacer means further comprises a second removable spacer means having a height ($D_2$), wherein $(D_1)+(D_2)<(D_3)$, the height of the receiving collar.

19. The structural support post assembly of claim 18, wherein the central post has a safety mark means functioning to warn a user not to support the central post at a height which places the safety mark means above a top edge of the receiving collar.

* * * * *